US008188963B2

(12) United States Patent
Park

(10) Patent No.: US 8,188,963 B2
(45) Date of Patent: May 29, 2012

(54) DRIVING CIRCUIT FOR LIQUID CRYSTAL DISPLAY DEVICE AND METHOD OF DRIVING THE SAME

(75) Inventor: Chang Keun Park, Daegu (KR)

(73) Assignee: LG Display Co., Ltd., Seoul (KR)

( * ) Notice: Subject to any disclaimer, the term of this patent is extended or adjusted under 35 U.S.C. 154(b) by 574 days.

(21) Appl. No.: 11/764,599

(22) Filed: Jun. 18, 2007

(65) Prior Publication Data

US 2008/0129652 A1 Jun. 5, 2008

(30) Foreign Application Priority Data

Jun. 19, 2006 (KR) ..... 10-2006-0054806

(51) Int. Cl.
*G09G 3/36* (2006.01)

(52) U.S. Cl. ..... 345/99

(58) Field of Classification Search ..... 345/98–100
See application file for complete search history.

(56) References Cited

U.S. PATENT DOCUMENTS

| | | | | |
|---|---|---|---|---|
| 6,707,441 | B1 * | 3/2004 | Hebiguchi et al. | 345/92 |
| 7,145,545 | B2 * | 12/2006 | Zebedee et al. | 345/100 |
| 7,385,576 | B2 * | 6/2008 | Moon | 345/87 |
| 7,391,401 | B2 * | 6/2008 | Kim et al. | 345/96 |
| 7,548,288 | B2 * | 6/2009 | Kim et al. | 345/104 |
| 7,586,476 | B2 * | 9/2009 | Kwon et al. | 345/98 |
| 2004/0125067 | A1 * | 7/2004 | Kim et al. | 345/98 |
| 2004/0263448 | A1 * | 12/2004 | Baek et al. | 345/87 |
| 2005/0231455 | A1 * | 10/2005 | Moon | 345/89 |
| 2006/0103619 | A1 * | 5/2006 | Kim | 345/98 |
| 2006/0103620 | A1 * | 5/2006 | Joo et al. | 345/98 |
| 2006/0232579 | A1 * | 10/2006 | Chen et al. | 345/211 |
| 2007/0097057 | A1 * | 5/2007 | Shin | 345/98 |
| 2007/0262976 | A1 * | 11/2007 | Matsuda et al. | 345/208 |

FOREIGN PATENT DOCUMENTS

| | | | |
|---|---|---|---|
| CN | 1573459 | A | 2/2005 |
| CN | 1707599 | A | 12/2005 |
| EP | 1492078 | A2 | 12/2004 |
| WO | WO 2006040904 | A1 * | 4/2006 |

* cited by examiner

*Primary Examiner* — Adam J Snyder
(74) *Attorney, Agent, or Firm* — Birch, Stewart, Kolasch & Birch, LLP

(57) ABSTRACT

A flat panel display device and a method of driving the same are disclosed, to cut down the cost of driving circuit by decreasing the number of data lines, wherein the flat panel display device comprises a plurality of gate and data lines which are formed on a substrate; an image displaying unit which includes a plurality of pixel cells of which two pixel cells adjacently positioned along the direction of gate line are driven by one data line; a timing controller which aligns source data provided from the external, and generates a control signal and a clock signal; a plurality of data-driving integrated circuits which convert the source data into analog video signals on the basis of the control signal and supply the analog video signals to the data line, and raise and output the clock signal; and a gate-driving circuit which generates scan signals overlapped by each unit corresponding to the half of one horizontal period according to the raised clock signal, and supplies the overlapped scan pulses to the gate lines in sequence.

12 Claims, 6 Drawing Sheets

DRIVING CIRCUIT FOR LIQUID CRYSTAL DISPLAY DEVICE AND METHOD OF DRIVING THE SAME

This application claims the benefit of Korean Patent Application No. 10-2006-54806 filed on Jun. 19, 2006, which is hereby incorporated by reference as if fully set forth herein.

BACKGROUND OF THE INVENTION

1. Field of the Invention

The present invention relates to a flat panel display device, and more particularly, to a flat panel display device to cut down the cost of driving circuit by decreasing the number of data lines, and a method of driving the same.

2. Discussion of the Related Art

Recently, various flat panel display devices have been developed to replace cathode ray tube (CRT) displays, which are bulky and heavy. Examples of flat panel display devices include liquid crystal display devices (LCD), field emission displays (FED), plasma display panels (PDP), and light emitting displays (LED).

Among the flat panel display devices, the LCD device displays images by controlling light transmittance of liquid crystal with use of an electric field. For this, the LCD device is comprised of an LCD panel including liquid crystal cells; and a driving circuit to drive the LCD panel.

The LCD panel includes switching elements which are formed in an area defined by a plurality of gate and data lines; and the plurality of liquid crystal cells which are respectively connected to the switching elements.

The switching element supplies a data voltage provided from the data line to the liquid crystal cell in response to a scan pulse provided from the gate line.

The liquid crystal cell may include a liquid crystal capacitor which is equivalently represented between a pixel electrode supplied with a data voltage and a common electrode supplied with a common voltage; and a maintenance capacitor which maintains the data voltage charged in the liquid crystal capacitor until the next data voltage is charged therein.

However, the related art LCD device has the following disadvantages.

With the high resolution of LCD device, the number of pixels increases so that the gate and data lines increase in number. Thus, the number of data-driving integrated circuits used increases, thereby increasing the cost of device.

SUMMARY OF THE INVENTION

Accordingly, the present invention is directed to a flat panel display device and a method of driving the same that substantially obviates one or more problems due to limitations and disadvantages of the related art.

An object of the present invention is to provide a flat panel display device to cut down the cost of driving circuit by decreasing the number of data lines used, and a method of driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a flat panel display device comprises a plurality of gate and data lines which are formed on a substrate; an image displaying unit which includes a plurality of pixel cells of which two pixel cells adjacently positioned along the direction of gate line are driven by one data line; a timing controller which aligns source data provided from the external, and generates a control signal and a clock signal; a plurality of data-driving integrated circuits which convert the source data into analog video signals on the basis of the control signal and supply the analog video signals to the data line, and raise and output the clock signal; and a gate-driving circuit which generates scan signals overlapped by each unit corresponding to the half of one horizontal period according to the raised clock signal, and supplies the overlapped scan pulses to the gate lines in sequence.

In another aspect, a method of driving a flat panel display device including a plurality of gate and data lines which are formed on a substrate, and an image displaying unit which includes a plurality of pixel cells of which two pixel cells adjacently positioned along the direction of gate line are driven by one data line comprises a first step of aligning source data supplied from the external, and generating a control signal and a clock signal; a second step of converting the data into analog video signals according to the control signal by using the plurality of data-driving integrated circuits, and raising the clock signal supplied from at least one of the data-driving integrated circuits; a third step of generating scan signals overlapped by each unit corresponding to the half of one horizontal period according to the raised clock signal by using a gate-driving circuit, and supplying the overlapped scan signals to the gate lines in sequence; and a fourth step of supplying the analog video signal to the data line in synchronization with the scan pulse.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a flat panel display device according to the preferred embodiment of the present invention and a method of driving the same will be described with reference to the accompanying drawings.

Figure 1:
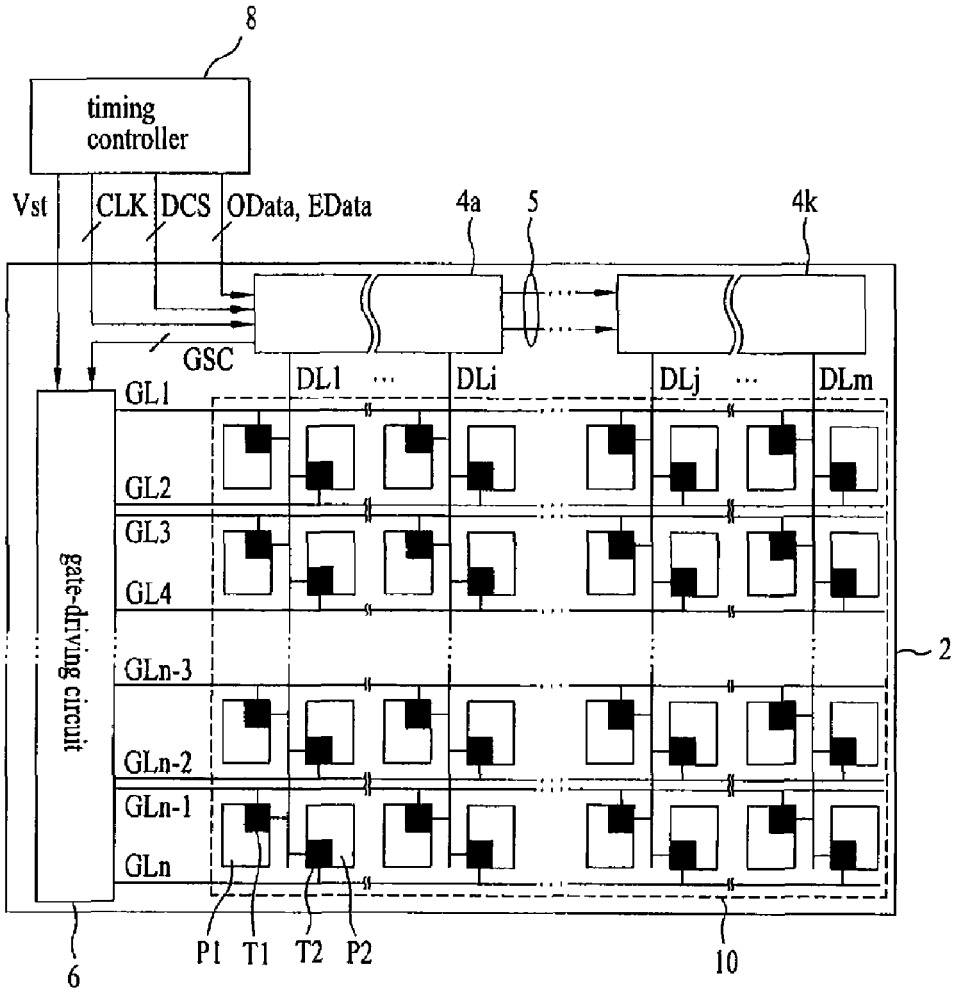
FIG. 1 is a schematic view of illustrating a flat panel display device according to the preferred embodiment of the present invention.

FIG. 1 is a schematic view of illustrating a flat panel display device according to the preferred embodiment of the present invention. Referring to FIG. 1, the flat panel display device according to the preferred embodiment of the present invention is comprised of a substrate 2; a plurality gate lines (GL1 to GLn) and data lines (DL1 to DLm) which are formed on the substrate 2; an image displaying unit 10 which includes a plurality of pixel cells of which two pixel cells (P1 and P2) adjacently positioned along the direction of gate line (GL1 to GLn) are driven by one data line (DL1 to DLm); a timing controller 8 which generates data (Data), control signals (DCS, Vst) and clock signals (CLK); a plurality of data-driving integrated circuits (4*a* to 4*k*) which are formed in a cascade method on the substrate 2 to convert the data (Data) into analog video signals on the basis of the data control signal (DCS) outputted from the timing controller 8, to supply the analog video signals to the data lines (DL1 to DLm), and to raise and output the plurality of clock signals (CLK); and a gate-driving circuit 6 which is formed at one side of the substrate 2 to supply scan signals generated based on the clock signals raised to the gate lines (GL1 to GLn) in sequence.

The image displaying unit 10 is comprised of a first switching element (T1) connected to a first side of each of the data lines (DL1 to DLm) and each of the odd-numbered gate lines (GL1, GL3, . . . , GLn−1); the first pixel cell (P1) connected to the first switching element (T1); a second switching element (T2) connected to a second side of each of the data lines (DL1 to DLm) and each of the even-numbered gate lines (GL2, GL4, . . . , GLn); and the second pixel cell (P2) connected to the second switching element (T2).

The first switching element (T1) is comprised of a gate electrode connected to each of the odd-numbered gate lines (GL1, GL3, . . . , GLn−1); a source electrode connected to the first side of each of the data lines (DL1 to DLm); and a drain electrode connected to the first pixel cell (P1). As the first switching element (T1) is turned-on by the scan pulse of the odd-numbered gate line (GL1, GL3, . . . , GLn−1), the first switching element (T1) supplies the analog video signal of each data line (DL1 to DLm) to the first pixel cell (P1).

The first pixel cell (P1) is positioned at the left side of each data line (DL1 to DLm) such that the first pixel cell (P1) is connected to the drain electrode of first switching element (T1). The first pixel cell (P1) displays the image corresponding to the analog video signal supplied by the first switching element (T1). At this time, the first pixel cell (P1) may be a liquid crystal cell which displays the image by controlling the light transmittance on the basis of analog video signal, or may be a light emitting cell which emits the light by a current on the basis of analog video signal.

The second switching element (T2) is comprised of a gate electrode connected to each of the even-numbered gate lines (GL2, GL4, . . . , GLn); a source electrode connected to the second side of each of the data lines (DL1 to DLm); and a drain electrode connected to the second pixel cell (P2). As the second switching element (T2) is turned-on by the scan pulse of the even-numbered gate line (GL2, GL4, . . . , GLn), the second switching element (T2) supplies the analog video signal of each data line (DL1 to DLm) to the second pixel cell (P2).

The second pixel cell (P2) is positioned at the right side of each data line (DL1 to DLm) such that the second pixel cell (P2) is connected to the drain electrode of second switching element (T2). The second pixel cell (P2) displays the image corresponding to the analog video signal supplied by the second switching element (T2). At this time, the second pixel cell (P2) is identical in structure to the first pixel cell (P1).

Figure 2:
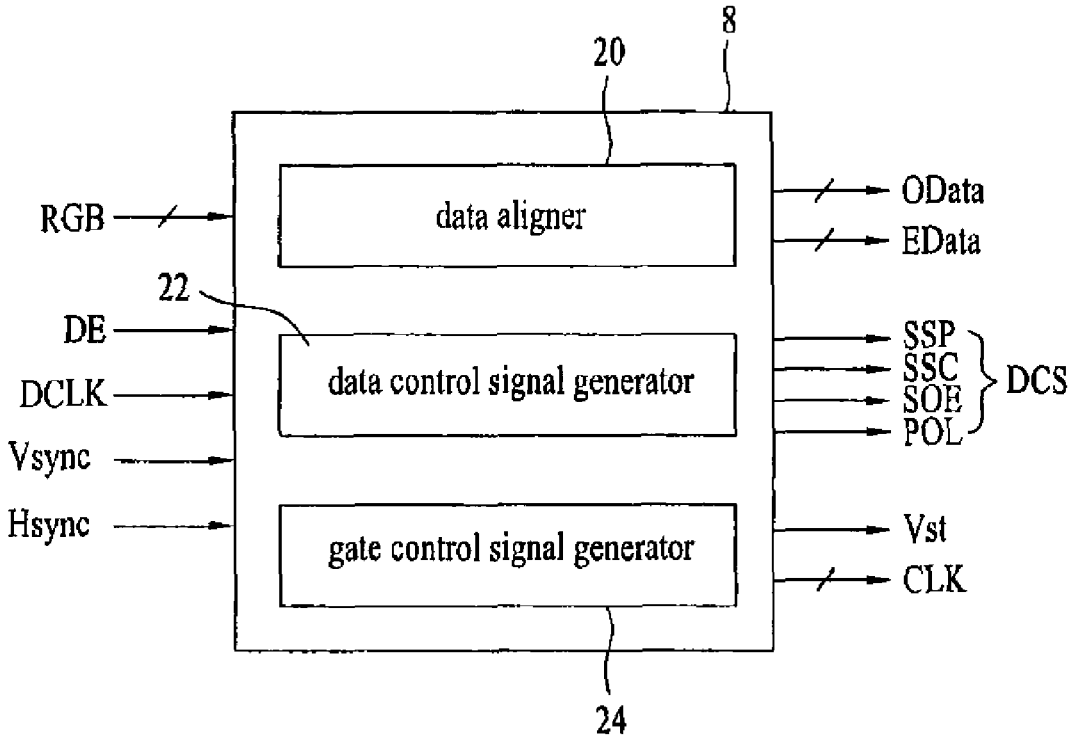
FIG. 2 is a block diagram of illustrating a timing controller shown in FIG. 1.

As shown in FIG. 2, the timing controller 8 is comprised of a data aligner 20; a data control signal generator 22; and a gate control signal generator 24.

The data aligner 20 aligns source data (RGB) supplied from the external to be suitable for driving the image displaying unit 10; divides the aligned data into odd-numbered data (OData) and even-numbered data (EData); and supplies the odd-numbered and even-numbered data (OData, EData) to the first data-driving integrated circuit 4*a* among the plurality of data-driving integrated circuits (4*a* to 4*k*).

The data control signal generator 22 generates the data control signal (DCS) including a source start pulse (SSP), a source shift clock (SSC), a source output signal (SOE) and a polarity control signal (POL) by using at least one of a data enable signal (DE), a dot clock (DCLK), vertically and horizontally synchronized signals (Vsync and Hsync); and supplies the generated data control signal (DCS) to the first data-driving integrated circuit 4*a*.

The gate control signal generator 24 generates a gate start signal (Vst) and a plurality of clock signals (CLK) by using at least one of the data enable signal (DE), the dot clock (DCLK), the vertically and horizontally synchronized signals (Vsync and Hsync) provided from the external. Then, the gate control signal generator 24 supplies the gate start signal (Vst) to the gate-driving circuit 6, and supplies the plurality of clock signals (CLK) to the first data-driving integrated circuit 4*a*.

The gate start signal (Vst) is generated by each frame. Also, the plurality of clock signals (CLK) are overlapped with each other by each period corresponding to the half of one horizontal period, whereby the plurality of clock signals (CLK) are delayed in sequence.

Figure 3:
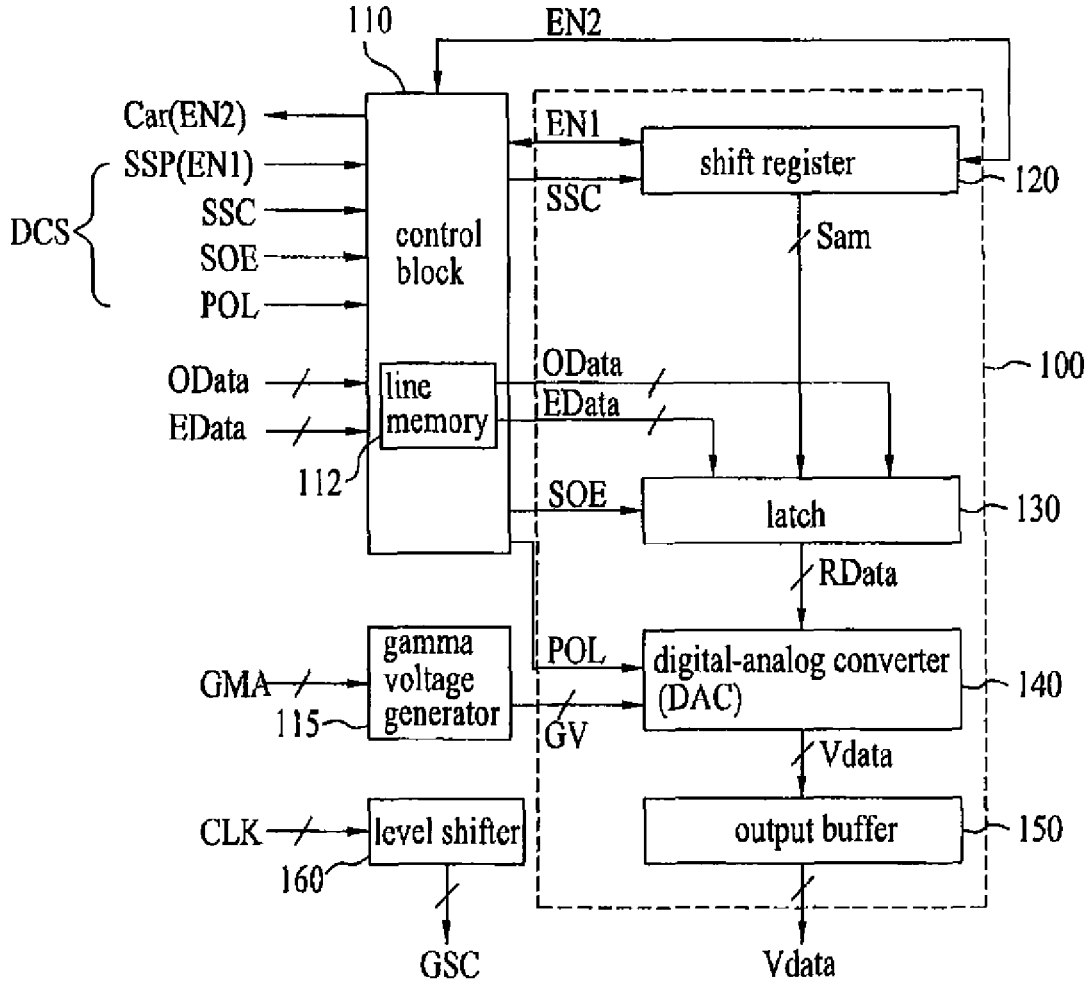
FIG. 3 is a block diagram of illustrating a data-driving integrated circuit shown in FIG. 1.

As shown in FIG. 3, each of the plurality of data-driving integrated circuits (4*a* to 4*k*) is comprised of a control block 110 which relays the data (OData, EData) and the data control signal (DCS) supplied from the timing controller 8; a gamma voltage generator 115 which generates a plurality of gamma voltages corresponding to the bit number of data (OData, EData); a level shifter 160 which raises the plurality of clock signals (CLK) supplied from the timing controller 8, and supplies the plurality of clock signals (CLK) raised to the gate-driving circuit 6; and a data converter 100 which samples and latches the data (OData, EData) supplied from the control block 110 on the basis of the data control signal (DCS) supplied from the control block 110, and converts the latched data (RData) into analog video signal (VData) by using the plurality of gamma voltages (VG).

The control block 110 transmits a first enable signal (EN1) corresponding to the source start pulse (SSP), and the source shift clock (SSC), the source output signal (SOE) and the polarity control signal (POL) to the data converter 100. Also, the control block 110 transmits the odd-numbered data (OData) and even-numbered data (EData) supplied from the timing controller 8 to the data converter 100. For this, the control block 110 is comprised of a line memory 112.

The line memory 112 temporarily stores the odd-numbered data (OData) and even-numbered data (EData) supplied from the timing controller 8, and outputs the stored odd-numbered data (OData) and even-numbered data (EData) to the data converter 100 in sequence. That is, the line memory 112 supplies the odd-numbered data (OData) to the data converter 100 in an initial period corresponding to the first half of one horizontal period (1H); and the line memory 112 supplies the even-numbered data (EData) to the data converter 100 in the latter half of one horizontal period (1H).

The gamma voltage generator 115 generates the plurality of gamma voltages (VG) by subdividing a gamma reference voltage (GMA) supplied from a gamma reference voltage generator (not shown) into parts on the basis of the gray-scale number of data (Data); and supplies the plurality of gamma voltage (GV) generated to the data converter 100.

Figure 4:
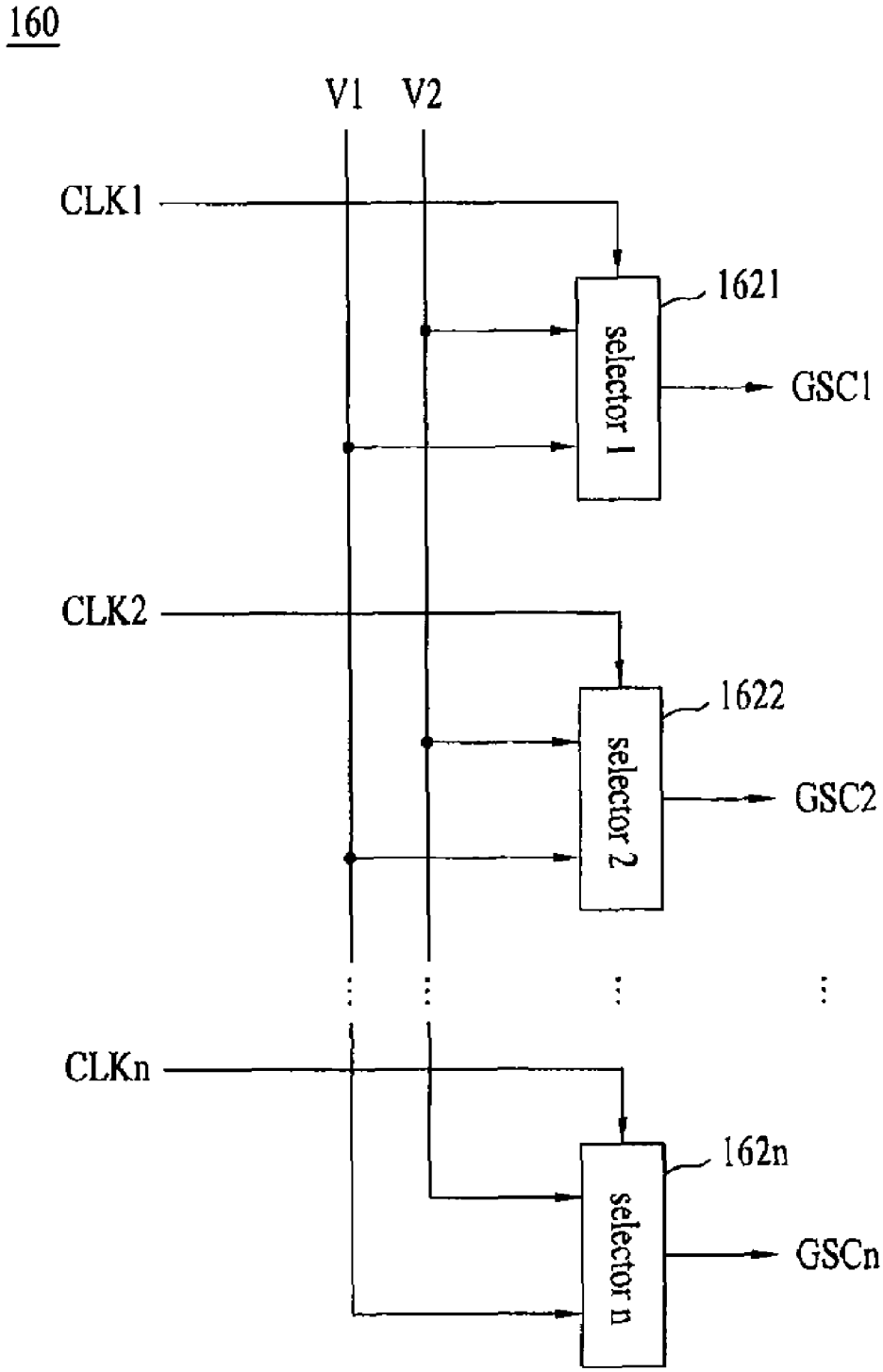
FIG. 4 is a circuit view of illustrating a level shifter shown in FIG. 3.

As shown in FIG. 4, the level shifter 160 includes a plurality of selectors (1621 to 162*n*) which selectively output first and second voltages (V1, V2) on the basis of the plurality of clock signals (CLK) supplied from the timing controller 8. Supposing that the plurality of clock signals (CLK) correspond to the four clock signals (CLK1 to CLK4).

If the clock signal (CLK) is in a high state, each of the selectors 1621 to 162*n* selects the first voltage (V1), and outputs a gate shift clock (GSC1 to GSCn) having the first voltage (V1). In the meantime, if the clock signal (CLK) is in a low state, each of the selectors 1621 to 162*n* selects the second voltage (V2), and outputs a gate shift clock (GSC1 to GSCn) having the second voltage (V2). In this case, the clock signal (CLK) of low state corresponds to 0V; the clock signal (CLK) of high state corresponds to 3.3V; and the first voltage (V1) is higher than the second voltage (V2). For example, the first voltage (V1) corresponds to 20V, and the second voltage (V2) corresponds to −5V.

Figure 5:
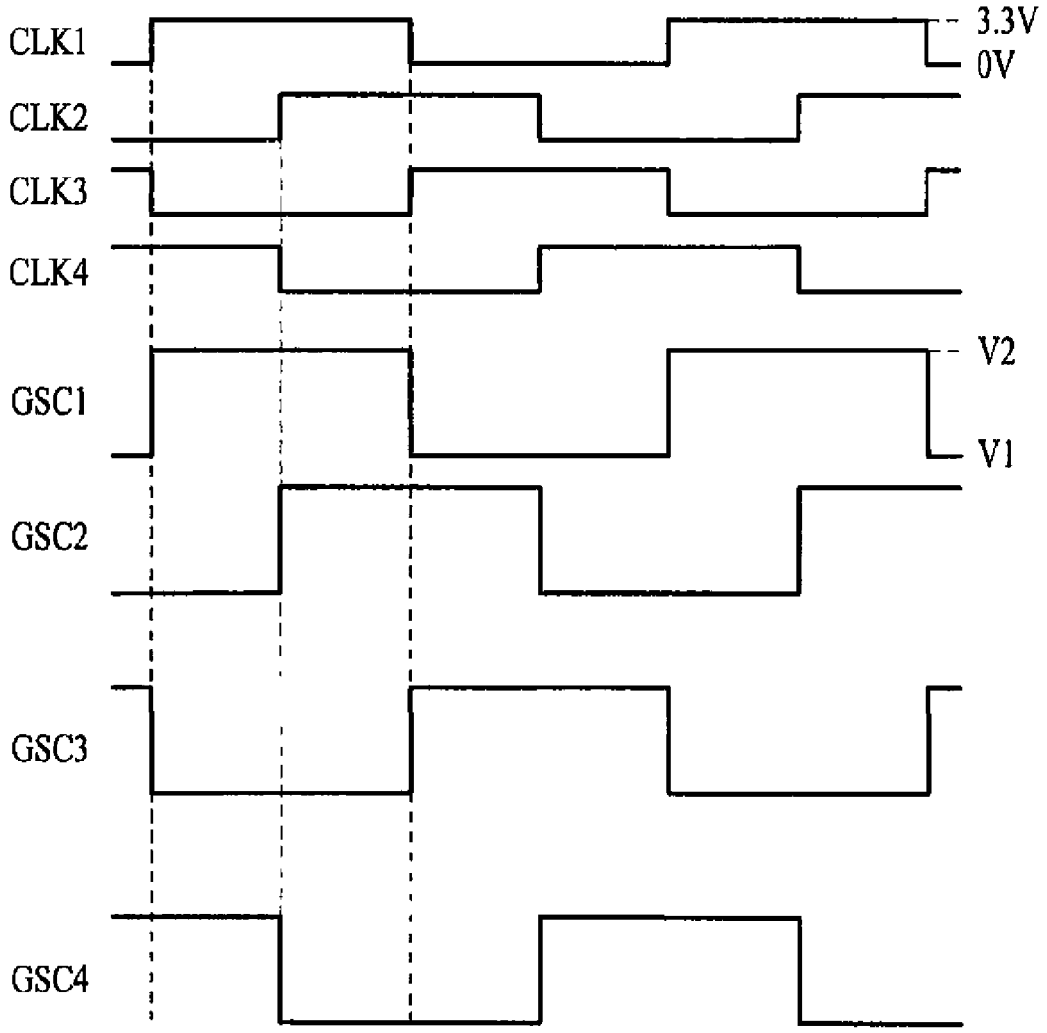
FIG. 5 is a waveform of illustrating input and output waveforms of a level shifter shown in FIG. 4.

As shown in FIG. 5, the level shifter 160 raises the voltage of the first to fourth clock signals (CLK1 to CLK4) to the first and second voltages (V1, V2); and supplies the raised first and second voltages (V1, V2) to the gate-driving circuit 6.

In FIG. 3, the data converter 100 is comprised of a shift register 120; a latch 130, a digital-analog converter (DAC) 140; and an output buffer 150.

The shift register 120 generates a sampling signal (Sam) by sequentially shifting the first enable signal (EN1) supplied from the control block 110 on the basis of the source shift clock (SSC) supplied from the control block 110; and supplies the generated sampling signal (Sam) to the latch 130. Then, a carry signal (Car) outputted from the shift register 120 is supplied to the control block 110. At this time, the control block 110 outputs a second enable signal (EN2) corresponding to the carry signal (Car) supplied from the shift register 120, wherein the second enable signal (EN2) functions as a source start pulse (SSP) to drive the next data-driving integrated circuit.

The latch 130 latches the odd-numbered data (OData) or even-numbered data (EData) for every one horizontal line (i) on the basis of the sampling signal (Sam) supplied from the shift register 120. Then, the latch 130 supplies the odd-numbered data (OData) or even-numbered data (EData) latched for one horizontal line (i) to the DAC 140 on the basis of the source output signal (SOE).

The DAC 140 selects the positive or negative polarity gamma voltage (GV) corresponding to the latched data (RData) supplied from the latch 130 among the plurality of different gamma voltages (GV) supplied from the gamma voltage generator 115; and supplies the selected gamma voltage to the output buffer 150 on the basis of the polarity control signal (POL) supplied from the control block 110, wherein the selected gamma voltage functions as the analog video signal (Vdata).

The output buffer 150 buffers the analog video signal (Vdata) supplied from the DAC 140, and supplies the buffered analog video signal (Vdata) to each data line (DL). At this time, the output buffer 150 amplifies and outputs the analog video signal (Vdata) in consideration for the load of data line (DL).

In the initial period corresponding to the first half of one horizontal period (1H), the data converter 100 converts the odd-numbered data (OData) into the analog video signal, and supplies the analog video signal to each data line (DL1 to DLm). In the latter half of one horizontal period (1H), the data converter 100 converts the even-numbered data (EData) into the analog video signal, and supplies the analog video signal to each data line (DL1 to DLm).

The plurality of data-driving integrated circuits (4*a* to 4*k*) are mounted on the substrate 2 in the cascade method such that the plurality of data-driving integrated circuits (4*a* to 4*k*) are respectively connected to the data lines (DL1 to DLm) of image displaying unit 10. Except the first data-driving integrated circuit 4*a*, the other data-driving integrated circuits are supplied from the data (OData, EData) and the data control signal (DCS) outputted from the preceding data-driving integrated circuit through a cascade connection line 5.

In FIG. 1, the gate-driving circuit 6 is driven by the gate start signal (Vst) outputted from the timing controller 8, so that the gate driving circuit 6 generates the scan pulses overlapped by each period corresponding to the half of one horizontal period on the basis of the plurality of gate shift clocks (GSC) supplied from the first data-driving integrated circuit 4*a*, and supplies the generated scan pulses to the respective gate lines (GL1 to GLn) in sequence.

Figure 6:
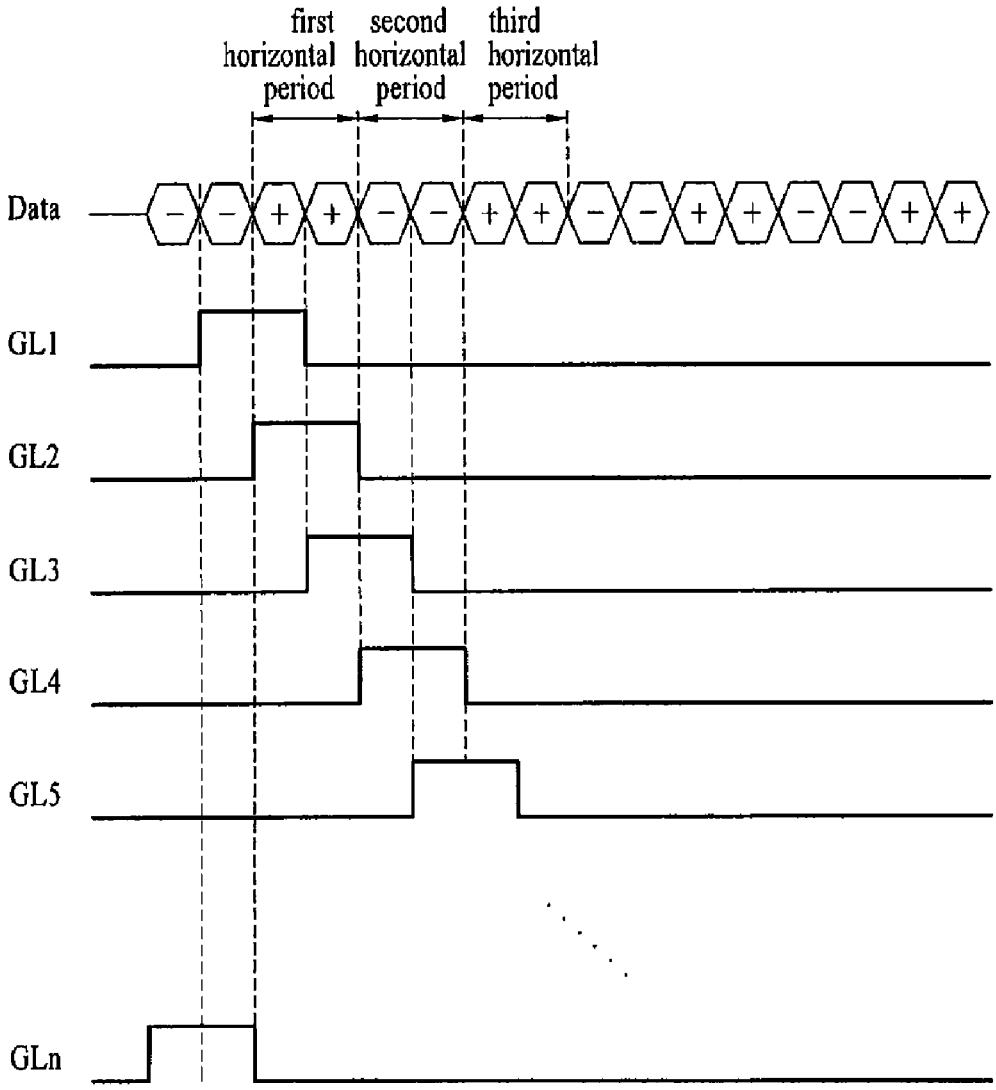
FIG. 6 is a waveform of illustrating a method of driving a flat panel display device according to the preferred embodiment of the present invention.

FIG. 6 is a waveform view of illustrating a driving method of a flat panel display device according to the preferred embodiment of the present invention.

A method of driving the flat panel display device according to the preferred embodiment of the present invention will be described with reference to FIG. 6 in connection with FIG. 1.

Supposing that the first pixel (P1) connected to the first gate line (GL1) is pre-charged with the analog video signal of negative polarity (−) by the scan pulse overlapped with the n-th gate line and the first gate line (GLn, GL1) in the n-th horizontal period before the first horizontal period. Then, the gate-driving circuit 6 generates the scan pulses overlapped by each period corresponding to the half of one horizontal period by using the gate start signal (Vst) supplied from the timing controller 8 and the plurality of gate shift clocks (GSC) supplied from the first data-driving integrated circuit 4*a*; and supplies the scan pulses to the respective gate lines (GL1 to GLn) in sequence.

In the overlapped portion of scan pulses supplied to the first and second gate lines (GL1, GL2) of the first horizontal period, the data-driving integrated circuits (4*a* to 4*k*) respectively convert the odd-numbered data (OData) into the analog video signal of positive polarity (+); and supply the analog video signal of positive polarity (+) to the data lines (DL1 to DLm). Accordingly, the first pixel cell (P1) connected to the first gate line (GL1) and pre-charged with the analog video signal of negative polarity (−) is charged with the analog video signal of positive polarity (+) supplied from each data line (DL1 to DLm). At this time, the second pixel cell (P2) connected to the second gate line (GL2) is pre-charged with the analog video signal of positive polarity (+) supplied from each data line (DL1 to DLm).

In the overlapped portion of scan pulses supplied to the second and third gate lines (GL2, GL3) of the first horizontal period, the data-driving integrated circuits (4*a* to 4*k*) respectively convert the even-numbered data (EData) into the analog video signal of positive polarity (+); and supply the analog video signal of positive polarity (+) to the data lines (DL1 to DLm). Accordingly, the second pixel cell (P2) connected to the second gate line (GL2) and pre-charged with the analog video signal of positive polarity (+) is charged with the analog video signal of positive polarity (+) supplied from each data line (DL1 to DLm). At this time, the first pixel cell (P1) connected to the third gate line (GL3) is pre-charged with the analog video signal of positive polarity (+) supplied from each data line (DL1 to DLm).

In the overlapped portion of scan pulses supplied to the third and fourth gate lines (GL3, GL4) of the second horizontal period, the data-driving integrated circuits 4*a* to 4*k* respectively convert the odd-numbered data (OData) into the analog video signal of negative polarity (−); and supply the analog video signal of negative polarity (−) to the data lines (DL1 to DLm). Accordingly, the first pixel cell (P1) connected to the third gate line (GL3) and pre-charged with the analog video signal of positive polarity (+) is charged with the analog video signal of negative polarity (−) supplied from each data line (DL1 to DLm). At this time, the second pixel cell (P2) connected to the fourth gate line (GL4) is pre-charged with the analog video signal of negative polarity (−) supplied from each data line (DL1 to DLm).

In the overlapped portion of scan pulses supplied to the fourth and fifth gate lines (GL4, GL5) of the second horizontal period, the data-driving integrated circuits 4*a* to 4*k* respectively convert the even-numbered data (EData) into the analog video signal of negative polarity (−); and supply the analog video signal of negative polarity (−) to the data lines (DL1 to DLm). Accordingly, the second pixel cell (P2) connected to the fourth gate line (GL4) and pre-charged with the analog video signal of negative polarity (−) is charged with the analog video signal of negative polarity (−) supplied from each data line (DL1 to DLm). At this time, the second pixel cell (P2) connected to the fifth gate line (GL5) is pre-charged with the analog video signal of negative polarity (−) supplied from each data line (DL1 to DLm).

The third to n-th horizontal periods are driven in the same method as those of the first and second horizontal periods.

As mentioned above, the flat panel display device according to the present invention and the method of driving the same have the following advantages.

In the flat panel display device according to the present invention and the method of driving the same, the adjacent two pixel cells are driven by one data line, so that it is possible to decrease the number of data lines by the half. Furthermore, the used number of data-driving integrated circuits is decreased owing to the decreased number of output channels for the data-driving integrated circuit, thereby lowering the cost of circuit.

Also, the data-driving integrated circuit is mounted on the substrate, and the gate-driving circuit is formed on the substrate with the image displaying unit. Thus, it is unnecessary for the flat panel display device to provide a driving board on which the driving circuit is mounted to drive the image displaying unit. Also, the line memory to store the data by each horizontal line and the level shifter to raise the clock signal are directly mounted on the data-driving integrated circuit, whereby the driving circuit is simplified in structure, thereby decreasing the cost of flat panel display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A driving circuit for liquid crystal display device comprising:

a plurality of gate and data lines which are formed on a substrate;

an image displaying unit which includes a plurality of pixel cells of which two pixel cells adjacently positioned along the direction of gate line are driven by one data line;

a timing controller which aligns source data provided from the external, and generates a control signal and a plurality of clock signals overlapped by each period corresponding to the half of one horizontal period;

a plurality of data-driving integrated circuits which are formed in a cascade method on the substrate to convert the data into analog video signals on the basis of the control signal and supply the analog video signals to the data line, and raise and output the clock signals supplied from the timing controller; and a gate-driving circuit which is formed at one side of the substrate to generates scan signals overlapped by each period corresponding to the half of one horizontal period according to the raised clock signals supplied from the data-driving integrated circuits, and supplies the overlapped scan pulses to the gate lines in sequence, wherein each of the plurality of data-driving integrated circuits comprises a control block which includes a line memory to store the odd-numbered and even-numbered data, and relays the data control signal, a gamma voltage generator which generates a plurality of different gamma voltages, and a data converter which samples and latches the data supplied from the line memory on the basis of the data control signal relayed in the control block, converts the latched data into the analog video signal by using the gamma voltage, and supplies the analog video signal to each data line, wherein each of the plurality of data-driving integrated circuits comprises a built-in level shifter which raises the plurality of clock signals supplied from the timing controller, and supplies the raised clock signals to the gate-driving circuit, wherein the control block outputs a first enable signal corresponding to the carry signal supplied from a shift register of the data converter, wherein the first enable signal functions as a source start pulse to drive the next data-driving integrated circuit, wherein the level shifter includes a plurality of selectors which selectively output first and second voltages having the different values on the basis of the plurality of clock signals overlapped by each period corresponding to the half of one horizontal period, wherein the line memory temporarily stores the odd-numbered data and even-numbered data supplied from the timing controller, and outputs the stored odd-numbered data and even-numbered data to the data converter in sequence, wherein the line memory supplies the odd-numbered data to the data converter in an initial period corresponding to the first half of one horizontal period and the line memory supplies the even-numbered data to the data converter in the latter half of one horizontal period, wherein each of the selectors are if the clock signal is in a high state, selects a first voltage, and outputs a gate shift clock having the first voltage, and the selectors are if the clock signal is in a low state, each of the selectors selects a second voltage, and outputs a gate shift clock having the second voltage, and wherein the gate-driving circuit is driven by the gate start signal outputted from the timing controller, so that the gate driving circuit generates the scan pulses overlapped by each period corresponding to the half of one horizontal period on the basis of the plurality of gate shift clocks supplied from each of the selectors, and supplies the generated scan pulses to the respective gate lines in sequence.

2. The driving circuit of claim 1, wherein the timing controller comprises:

a data aligner which aligns the source data, and divides the aligned data into odd-numbered data and even-numbered data;

a data control signal generator which generates a data control signal to control the data-driving integrated circuit by using a synchronization signal provided from the external; and a gate control signal generator which generates a gate start signal and the plurality of clock signals to drive the gate-driving circuit by using the synchronization signal.

3. The driving circuit of claim 2, wherein the plurality of clock signals are delayed in sequence to be overlapped by each period corresponding to the half of one horizontal period.

4. The driving circuit of claim 3, wherein the first voltage is higher than the second voltage.

5. The driving circuit of claim 3, wherein the data converter supplies the analog video signal converted from the odd-numbered data to each data line in an initial period corresponding to the first half of one horizontal period, and supplies the analog video signal converted from the even-numbered data to each data line in the latter half of one horizontal period.

6. The driving circuit of claim 3, wherein the gate-driving circuit generates the scan signal according to the clock signal supplied from the level shifter as the gate-driving circuit formed at one side of the substrate is driven by the gate start signal supplied from the timing controller.

7. A driving method for liquid crystal display device including a plurality of gate and data lines which are formed on a substrate, and an image displaying unit which includes a plurality of pixel cells of which two pixel cells adjacently positioned along the direction of gate line are driven by one data line comprising:

a first step of aligning source data supplied from the external, and generating a control signal and a plurality of clock signals overlapped by each period corresponding to the half of one horizontal period;

a second step of converting the data into analog video signals according to the control signals by using a plurality of data-driving integrated circuits which are formed in a cascade method on the substrate, and raising the clock signals supplied from at least one of the data-driving integrated circuits;

a third step of generating scan signals overlapped by each period corresponding to the half of one horizontal period according to the raised clock signals supplied from the data-driving integrated circuits by using a gate-driving circuit which is formed at one side of the substrate, and supplying the overlapped scan signals to the gate lines in sequence; and a fourth step of supplying the analog video signal to the data line in synchronization with the scan pulse, wherein the second step comprises storing the odd-numbered and even-numbered data in a line memory, and relaying the data control signal, generating a plurality of different gamma voltages, and sampling and latching the data supplied from the line memory on the basis of the data control signal, and converting the latched data into the analog video signal by using the gamma voltage, wherein the second step comprises raising the plurality of clock signals supplied from the timing controller, and supplies the raised clock signals to the gate-driving circuit by using each of the plurality of data-driving integrated circuits a built-in level shifter, wherein the control block outputs a first enable signal corresponding to the carry signal supplied from a shift register of the data converter, wherein the first enable signal functions as a source start pulse to drive the next data-driving integrated circuit, wherein the level shifter includes a plurality of selectors which selectively output first and second voltages having the different values on the basis of the plurality of clock signals overlapped by each period corresponding to the half of one horizontal period, wherein the line memory temporarily stores the odd-numbered data and even-numbered data supplied from the timing controller, and outputs the stored odd-numbered data and even-numbered data to the data converter in sequence, wherein the line memory supplies the odd-numbered data to the data converter in an initial period corresponding to the first half of one horizontal period and the line memory supplies the even-numbered data to the data converter in the latter half of one horizontal period, wherein each of the selectors are if the clock signal is in a high state, selects a first voltage, and outputs a gate shift clock having the first voltage, and the selectors are if the clock signal is in a low state, each of the selectors selects a second voltage, and outputs a gate shift clock having the second voltage, and wherein the gate-driving circuit is driven by the gate start signal outputted from the timing controller, so that the gate driving circuit generates the scan pulses overlapped by each period corresponding to the half of one horizontal period on the basis of the plurality of gate shift clocks supplied from each of the selectors, and supplies the generated scan pulses to the respective gate lines in sequence.

8. The driving method of claim 7, wherein the first step comprises:

aligning the source data, and dividing the aligned source data into odd-numbered data and even-numbered data; and generating a data control signal to control the data-driving integrated circuit, and a gate start signal and the plurality of clock signals to drive the gate-driving circuit, by using a synchronization signal.

9. The driving method of claim 8, wherein the plurality of clock signals are delayed in sequence to be overlapped by each period corresponding to the half of one horizontal period.

10. The driving method of claim 9, wherein the third step generates the scan signal according to the clock signal supplied from the level shifter, and supplies the scan signal to the gate line in sequence as the gate-driving circuit formed at one side of the substrate is driven by the gate start signal supplied from the timing controller.

11. The driving method of claim 8, wherein the first voltage is higher than the second voltage.

12. The driving method of claim 8, wherein the fourth step converts the odd-numbered data into the analog video signal, and supplies the analog video signal to each data line in an initial period corresponding to the first half of one horizontal period, and converts the even-numbered data into the analog video signal, and supplies the analog video signal to each data line in the latter half of one horizontal period.

* * * * *